United States Patent [19]

Weyler

[11] Patent Number: 4,655,641

[45] Date of Patent: Apr. 7, 1987

[54] APPARATUS FOR ALIGNING A PLATFORM DECK AND JACKET

[75] Inventor: Michael E. Weyler, Houston, Tex.

[73] Assignee: Exxon Production Research Co., Houston, Tex.

[21] Appl. No.: 789,237

[22] Filed: Oct. 18, 1985

[51] Int. Cl.[4] ..... E02D 25/00

[52] U.S. Cl. ..... 405/204; 405/195; 405/227; 267/141.2; 267/153; 403/13; 403/372

[58] Field of Search ..... 405/204, 203, 211, 212, 405/215, 227, 195; 52/118, 117; 267/141.2, 153, 63 R; 403/372, 13

[56] References Cited

U.S. PATENT DOCUMENTS

| | | | |
|---|---|---|---|
| 3,275,275 | 9/1966 | Erhart et al. | 267/141.2 |
| 3,323,763 | 6/1967 | Butts | 267/153 |
| 3,541,800 | 11/1970 | Walker et al. | 405/211 |
| 4,222,683 | 9/1980 | Schaloske et al. | 405/204 |
| 4,242,011 | 12/1980 | Karsan et al. | 405/204 |
| 4,252,469 | 2/1981 | Bligh et al. | 405/204 |
| 4,284,367 | 8/1981 | Tuson et al. . | |
| 4,408,930 | 10/1983 | Ninet et al. | 405/204 X |
| 4,408,931 | 10/1983 | Leblanc et al. | 405/211 X |
| 4,436,454 | 3/1984 | Ninet et al. | 405/204 |

*Primary Examiner*—Cornellus J. Husar
*Assistant Examiner*—Todd G. Williams
*Attorney, Agent, or Firm*—Kenneth C. Johnson

[57] ABSTRACT

The present invention provides an apparatus for aligning an integrated deck carried on a barge with a jacket secured to the seafloor. The apparatus comprises a plurality of cantilevered springs extending vertically downward from the deck and a plurality of sockets secured to the jacket, each socket being positioned to receive the lower end of one of the cantilevered springs. As the cantilevered springs are lowered into the sockets, wind or wave induced horizontal motion of the deck is accommodated by tilting of receiving members in the sockets. Once the cantilevered springs are fully engaged with the sockets, the receiving members no longer tilt and the great stiffness of the cantilevered springs permits only very slight horizontal motion of the deck so that the barge can be ballasted downward to transfer the deck load to the jacket without misalignment.

12 Claims, 7 Drawing Figures

APPARATUS FOR ALIGNING A PLATFORM DECK AND JACKET

FIELD OF THE INVENTION

The present invention relates to mating decks and jackets for offshore platforms. More particularly, the present invention relates to an apparatus for aligning an integrated deck carried on a barge with a jacket secured to the seafloor.

BACKGROUND OF THE INVENTION

In offshore petroleum operations, platforms comprising a jacket secured to the seafloor and a deck mounted on top of the jacket are commonly used to drill for and produce oil and gas. Typically, the deck is mated to the jacket after the jacket has been installed. This is usually accomplished by lifting individual components of the deck, including deck sections, crew facilities, and drilling and production equipment, onto the jacket with a barge-mounted crane. After the individual components are lifted onto the jacket, they are integrated together.

This approach generally works quite well, but costs can be very high due to the offshore construction required. Offshore construction is very expensive for a number of reasons, including down-time caused by rough weather and the need for special offshore construction vessels. In the case of very large platforms or platforms located in remote areas, offshore construction may require as much as one million manhours and ten months to complete.

There is another approach to mating platform decks and jackets, called the integrated deck approach, which has been introduced in recent years. With the integrated deck approach, a one-piece deck is used, with most or all components being integrated together at an onshore construction yard. By using an integrated deck, offshore construction time is greatly reduced. This not only substantially reduces offshore construction costs, it also makes the approach attractive for offshore areas having short construction seasons due to rough seas or due to the presence of sea ice.

Because an integrated deck consists of a single unit comprising most or all of the components used for drilling and production, it is very heavy. For this reason, integrated decks are not lifted onto platform jackets with barge-mounted cranes. Instead, the integrated deck is carried on a barge to the jacket, and the barge is then ballasted to lower the integrated deck onto the jacket. Typically, the jacket will have a slot into which the barge is maneuvered. The integrated deck extends over both sides of the barge and mates with the jacket as the barge is ballasted downward.

Since the integrated deck is carried by a barge during the mating operation, it is subject to movement caused by the action of wind on the barge and deck, and more importantly, by the action of waves on the barge. This movement can make proper alignment of the integrated deck with the jacket very difficult. Although various apparatus for aligning integrated decks with jackets have been used and proposed, these apparatus are generally not satisfactory for use in seas exceeding one or two feet, or are too complicated and expensive to be practical. Thus, the integrated deck approach is currently limited to areas where higher seas are not likely during the mating operation. Thus, the advantages offered by the integrated deck approach currently cannot be realized to the extent desired by the petroleum industry. For this reason, there is a need for a practical apparatus which can permit the alignment of an integrated deck with a jacket in higher seas. The present invention is aimed at providing such an apparatus.

SUMMARY OF THE INVENTION

The present invention is an apparatus for aligning an integrated deck carried on a barge with a jacket secured to the seafloor. The apparatus comprises a plurality of cantilevered springs extending vertically downward from the integrated deck and a plurality of sockets secured to the jacket, each socket being positioned to receive the lower end of one of the cantilevered springs. Each socket comprises a base, a receiving member adapted to receive the lower end of one of the cantilevered springs, and a resilient member positioned around the receiving member. The receiving member is secured to the base in a manner which permits the receiving member to tilt in response to lateral forces applied to the receiving member above its bottom end but which does not permit the receiving member to tilt in response to lateral forces applied to the receiving member at its bottom end. The resilient member which surrounds the receiving member is adapted to apply a restoring force to the receiving member when the receiving member tilts.

In the preferred embodiment, each cantilevered spring comprises a steel tubular, and means are provided for raising and lowering the cantilevered springs relative to the deck. The deck is first maneuvered into a slot in the jacket. The barge is then moored to the jacket and the cantilevered springs on the deck are lowered into the sockets on the jacket. As each cantilevered spring is lowered into a socket, it first makes contact with the top end of the socket's receiving member. If the barge and deck should move horizontally under the influence of wind or waves, the lateral force applied to the top of the receiving member by the cantilevered spring will cause the receiving member to tilt. This permits horizontal motion of the deck relative to the jacket without disengagement of the cantilevered spring from the receiving member. Any wave induced vertical motion of the deck is accommodated by the freedom of the cantilevered springs to slide up and down in the sockets.

As each cantilevered spring is lowered into a socket, the stiffness of the receiving member increases, and it becomes more resistant to tilting, thereby causing the cantilevered spring to absorb more of the lateral force. Once the cantilevered spring is lowered to or through the bottom end of the receiving member, the receiving member no longer tilts and the great stiffness of the cantilevered spring reduces horizontal motion of the deck to a minimum. At this point, the barge is ballasted to lower the deck onto the jacket, the barge is disengaged from the deck, and the deck and jacket are secured together to complete the mating operation.

DESCRIPTION OF THE PREFERRED EMBODIMENT

Figure 1:
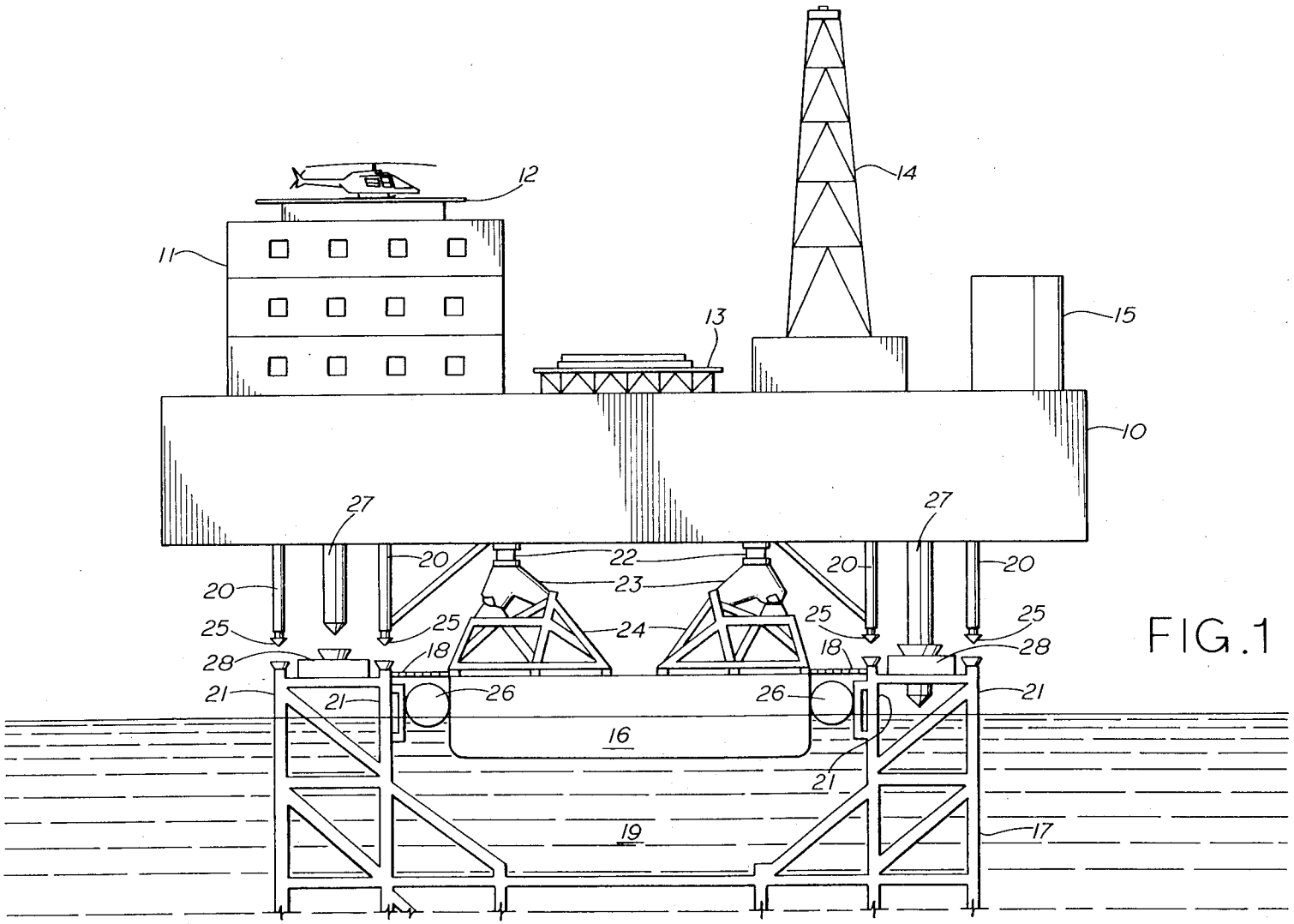
FIG. 1 is a side view of an integrated deck carried on a barge for mating with a jacket.

Referring to FIG. 1, integrated deck 10 can be seen. The integrated deck includes the equipment and facilities needed for offshore drilling and production. Examples of such equipment and facilities include crew quarters 11, helicopter pad 12, pipe rack 13, drilling mast 14 and treating facilities 15. The deck is carried on barge 16 and is positioned over jacket 17 for a deck-to-jacket mating operation. The barge is secured by mooring lines 18 to the jacket within slot 19 in the top of the jacket. The bottom of the jacket (not shown) is secured to the seafloor. The mooring lines are adjusted so that deck legs 20 align as closely as possible with jacket legs 21. During the mating operation, the deck load is transferred from the barge to the jacket by ballasting the barge downward until the deck legs rest on the jacket legs.

Prior to mating, as shown in FIG. 1, the deck load is supported on the barge by shear pads 22, drop blocks 23 and load frames 24. The deck load rests on the shear pads, which are attached to the drop blocks, which in turn are supported by the load frames. The drop blocks are adapted to drop rapidly downward when triggered, so that the barge can be quickly disengaged from the deck after the deck load has been transferred from the barge to the jacket. Drop blocks are well known to those skilled in the art and are designed to drop downward a sufficient distance so that the barge will not be slammed by waves into the bottom of the deck after disengagement. Load transfer mechanisms 25 are carried by the deck legs to minimize or eliminate impacts between the deck legs and jacket legs caused by wave induced vertical movement of the barge and deck during the mating operation. Such load transfer mechanisms are well known to those skilled in the art. Buoyant flexible fenders 26 are also well known to those skilled in the art and are used to dampen impacts between the barge and jacket.

The description to this point has focused only on those features of FIG. 1 which are well known in the art and which do not comprise the subject matter of the present invention. The description now turns to the apparatus of the present invention, which comprises cantilevered spring 27 and sockets 28. The cantilevered springs and sockets are designed to align the deck with the jacket and to minimize horizontal motion of the deck during mating. By using the apparatus of the present invention, integrated decks can be safely mated with jackets in higher seas than is practical using existing apparatus. The manner in which the apparatus accomplishes this will now be described in detail.

Figure 2C:
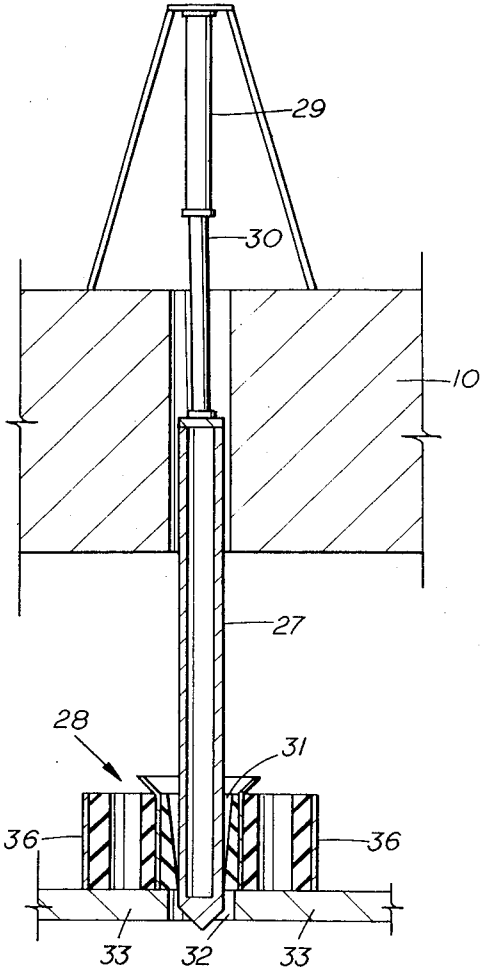
FIGS. 2A, B and C are cross-sectional side views of the apparatus of the present invention in three different stages of engagement.

In FIG. 1, one of cantilevered springs 27 is shown prior to engagement with one of sockets 28, and the other cantilevered spring is shown fully engaged, extending downward through the other socket. For most applications, two cantilevered springs should be sufficient, but more may be desired for very heavy deck loads. Referring now to the cross-sectional side views shown in FIG. 2, the stages of engagement between the cantilevered springs and the sockets can be seen. In FIG. 2A, cantilevered spring 27 can be seen just prior to engagement with socket 28. Cantilevered spring 27 extends vertically downward from deck 10. In the preferred embodiment, means for raising and lowering the cantilevered spring relative to the deck, such as hydraulic cylinder 29 and piston arm 30, are provided. The cantilevered spring is preferably a very strong and very stiff steel tubular which together with the other cantilevered spring(s) can carry all lateral loads between the deck and the jacket caused by wave or wind induced horizontal motion of the deck during the mating operation. As the cantilevered spring is lowered, it engages with receiving member 31 of the socket.

Figure 2B:
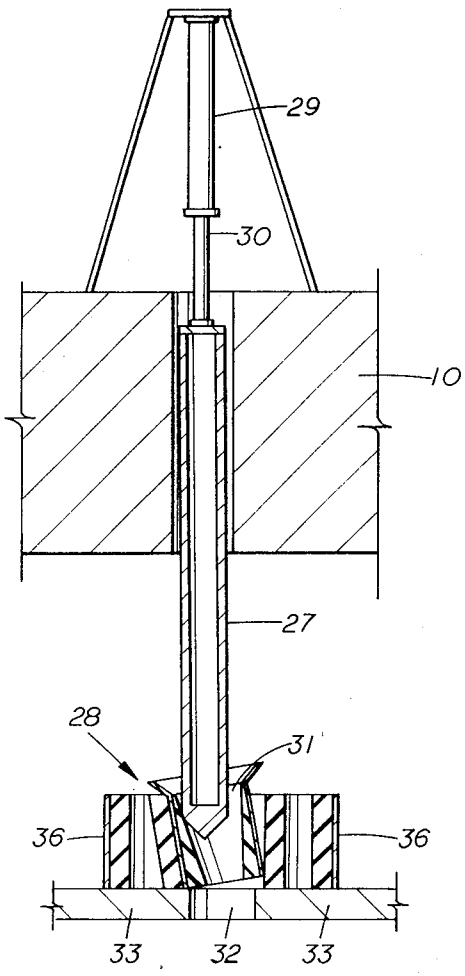
Figure 2A:
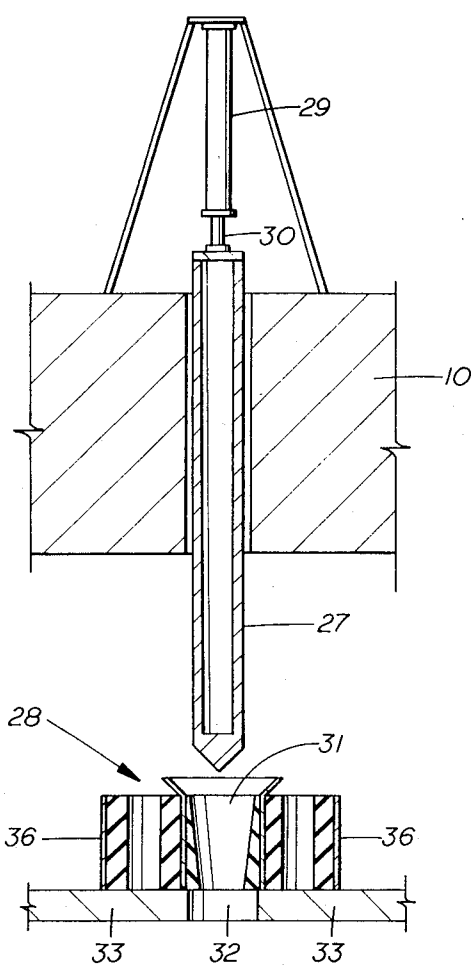

As seen in FIG. 2B, when cantilevered spring 27 is lowered, it first comes into contact with receiving member 31 near the top end of the receiving member. As will be explained in more detail below, the receiving member is adapted to tilt in response to lateral forces applied above its bottom end. These lateral forces result from horizontal motion of the deck. Tilting of the receiving member permits horizontal motion of the deck to occur without the cantilevered spring disengaging from the socket. The tilting can be seen in FIG. 2B. When lateral forces are applied near the top end of the receiving member, the stiffness of the receiving member, that is its resistance to tilting, is very soft relative to the stiffness of the cantilevered spring. Thus, when the cantilevered spring is in the position shown in FIG. 2B, the horizontal motion of the deck is accommodated almost entirely by tilting of the receiving member, and not by bending of the cantilevered spring. This changes, however, as the cantilevered spring is lowered further into the receiving member. The further the cantilevered spring is lowered into the receiving member, the stiffer, or more resistant to tilting, the receiving member becomes.

When the cantilevered spring is lowered to or through the bottom end of the receiving member for full engagement as illustrated in FIG. 2C, the receiving member will no longer tilt, and all lateral force is absorbed by bending of the cantilevered spring, with the socket acting like a pivot point for the bottom of the cantilevered spring. The other pivot point for the cantilevered spring is where it passes through deck 10. No lateral force is carried by hydraulic cylinder 29 or piston arm 30. Since the cantilevered spring is very stiff, it permits very little horizontal movement of the deck once it is fully engaged with the socket. By preventing anything more than slight horizontal movement of the deck, the barge can then be ballasted downward until the deck load is transferred from the barge to the jacket by resting the deck legs on the jacket legs. As the barge is ballasted, the cantilevered spring freely slides further downward through the receiving member and through opening 32 in base 33. In the same manner, any wave induced vertical motion of the deck prior to load transfer is accommodated by the ability of the cantilevered spring to freely slide up and down within the receiving member.

Figure 4:
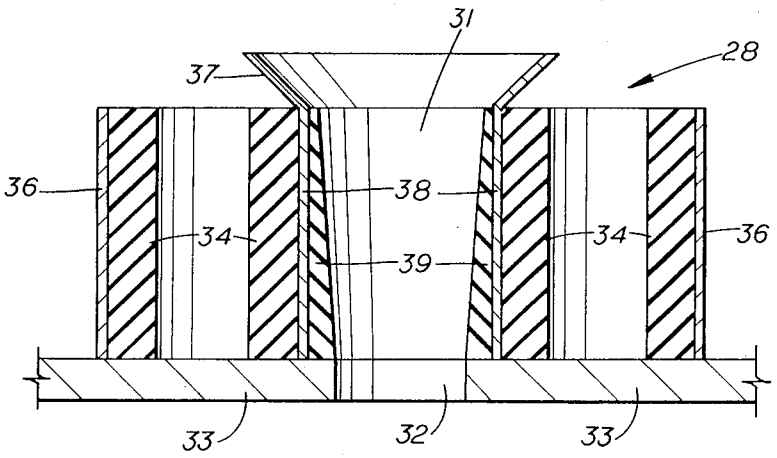
FIG. 4 is a cross-sectional side view of the socket taken along line 4—4 of FIG. 3.
Figure 5:
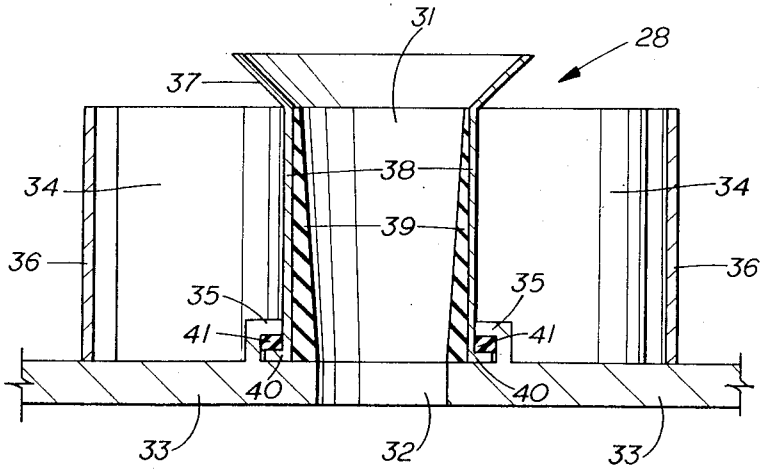
FIG. 5 is a cross-sectional side view of the socket taken along line 5—5 of FIG. 3.
Figure 3:
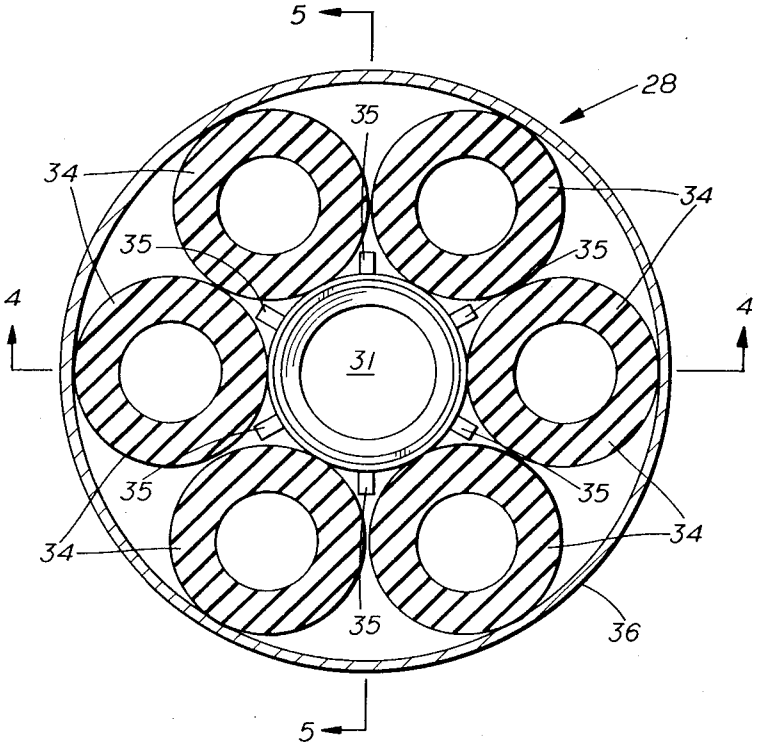
FIG. 3 is a plan view of a socket of the apparatus.

Referring to FIGS. 3, 4 and 5, socket 28 will now be described in more detail. As seen in the plan view shown in FIG. 3, there are preferably six resilient cylinders 34 surrounding receiving member 31. The resilient cylinders and the receiving member preferably have substantially the same outer diameter. Although resilient cylinders are preferred, other types of resilient members positioned around the receiving member can be used. The resilient cylinders are adapted to apply a restoring force to the receiving member when the receiving member tilts. Clips 35 secure the receiving member to the socket while permitting the receiving member to tilt, as will be described in more detail below. When the receiving member is not tilted, its longitudinal axis extends in the vertical direction, as does the longitudinal axis of each of the resilient cylinders. Rigid housing 36 surrounds the resilient cylinders and holds them in the socket.

Referring now to FIG. 4, which is a cross-sectional side view taken along line 4—4 of FIG. 3, more detail of socket 28 can be seen. The socket has base 33 to which rigid housing 36 and receiving member 31 are secured. Resilient cylinders 34 either rest in or are secured to the base. Resilient cylinders 34 are preferably made of reinforced rubber, and rigid housing 36 is preferably made of steel. Receiving member 31 has guide funnel 37 at its top end to help guide a cantilevered spring into the receiving member as the cantilevered spring is lowered. The receiving member preferably has outer rigid portion 38 made of steel and inner resilient portion 39 made of reinforced rubber. Preferably, the inner resilient portion is shaped to give the receiving member a wider internal diameter at its top end and a narrower internal diameter at its bottom end. The narrower internal diameter at the bottom end of the receiving member is preferably slightly larger than the outer diameter of the lower end of the cantilevered spring. This permits the lower end of the cantilevered spring to pass through the bottom end of the receiving member, and restrains the lower end of the cantilevered spring from substantial horizontal motion.

Turning to FIG. 5, which is a cross-sectional side view of socket 28 taken along line 5—5 of FIG. 3, the manner in which receiving member 31 is permitted to tilt will be described. Receiving member 31 is secured to base 33 of the socket in a manner which permits the receiving member to tilt in response to lateral forces applied above its bottom end, but which does not permit the receiving member to tilt in response to lateral forces applied at its bottom end. This is accomplished by studs 40, clips 35 and resilient pads 41. Studs 40 are attached to the bottom end of the receiving member and clips 35 are attached to base 33. Each of the clips is positioned to align with one of the studs, and between each clip and its corresponding stud is a resilient pad, preferably made of rubber. When a lateral force is applied to the receiving member above its bottom end, the resilient pads deform to permit the receiving member to tilt. The clips and studs prevent the receiving member from being pulled out of the socket. When the lateral force is removed, the receiving member returns to an upright position due to the restoring force applied by the pads and by the resilient cylinders. As explained above, lateral force is applied to the receiving member above its bottom end during engagement of the cantilevered spring with the socket. During engagement, the receiving member will typically be tilted back and forth in an oscillatory motion as a result of the action of waves on the barge. As the cantilevered spring is lowered further into the receiving member, the receiving member gets stiffer and more resistant to tilting due to the reduced leverage of the cantilevered spring against the receiving member. Finally, when the cantilevered spring is lowered to or through the bottom end of the receiving member, the receiving member will no longer tilt, and the stiffness of the cantilevered spring rather than the stiffness of the receiving member will determine the amount of horizontal deck motion. Since the cantilevered spring is very stiff, horizontal deck motion will be slight and will not prevent proper alignment of the deck legs and jacket legs.

Referring again to FIG. 1, it will be apparent that fenders 26, mooring lines 18, shear pads 22, cantilevered springs 27 and sockets 28 all contribute to some extent to reducing or accommodating horizontal motion of deck 10. The primary function of the fenders is to protect jacket 17 from damage by barge 16 during positioning, mooring, mating and withdrawal. The fenders are not designed to hold the barge rigidly in position. The mooring lines are primarily used to hold the barge in position, but are not able to reduce horizontal motion of the barge to a degree which would permit proper alignment of deck legs 20 and jacket legs 21 in anything but relatively small seas. As explained above, it is the cantilevered springs and sockets which permit proper alignment, despite the existence of higher seas.

Prior to transfer of the deck load from the barge to the jacket, the entire deck load is supported by shear pads 22. While acting as supports, the shear pads are also capable of lateral deflection under a shear load, such as might occur when the barge is rolling or pitching in waves. As will be recognized by those skilled in the art, the shear pads should be designed to an appropriate size and stiffness. Due to wave action, shear pads which are too soft can cause overstressing of the jacket, and shear pads which are too stiff can cause overstressing of the cantilevered springs. Well known design practices can be used to calculate the proper size and stiffness for the shear pads and for the cantilevered springs, based primarily on barge size, deck load and design sea state.

As described above, the present invention provides a practical apparatus for aligning an integrated deck with a jacket. Thus, the apparatus of the present invention should enable wider use of the integrated deck approach, thereby resulting in substantial offshore construction savings.

Inasmuch as the present invention is subject to many variations, modifications and changes in detail, it is intended that all subject matter discussed above and shown in the accompanying drawings be interpreted as illustrative and not as a limiting sense. For example, the apparatus of the present invention could be used to align superstructures and substructures other than decks and jackets during mating operations. To illustrate, the apparatus of the present invention could be used to align an offshore tanker loading terminal with its base, to align the deck of a tension leg platform with a tension leg substructure that is secured to the seafloor, or to align the deck of a gravity-base platform with a gravity-base that is resting on the seafloor. Such variations, modifications and changes in detail are included within the scope of the present invention as defined by the following claims.

What I claim is:

1. An apparatus for aligning a superstructure with a substructure that is secured to or resting on the seafloor, said superstructure being carried by a floating vessel, said apparatus comprising:

(a) a plurality of cantilevered springs extending vertically downward from said superstructure; and (b) a plurality of sockets secured to said substructure, each of said sockets being positioned to receive the lower end of one of said cantilevered springs, each of said sockets comprising:

(i) a base;

(ii) a receiving member adapted to receive the lower end of one of said cantilevered springs, said receiving member being secured to said base in a manner which permits said receiving member to tilt in response to lateral forces applied to said receiving member above its bottom end but which does not permit said receiving member to tilt in response to lateral forces applied to said receiving member at its bottom end; and (iii) a plurality of resilient members positioned around said receiving member, said resilient members being adapted to apply a restoring force to said receiving member when said receiving member tilts.

2. The apparatus of claim 1 wherein each of said cantilevered springs comprises a steel tubular.

3. The apparatus of claim 1 and further comprising means for raising and lowering said cantilevered springs relative to said superstructure.

4. The apparatus of claim 1 wherein said receiving member has an opening extending vertically therethrough, said opening being adapted to receive the lower end of one of said cantilevered springs, said opening being wider at its top end and narrower at its bottom end, the bottom end of said opening being slightly larger than the outer diameter of the lower end of said cantilevered spring.

5. The apparatus of claim 4 wherein said receiving member is a cylinder having its longitudinal axis extending in the vertical direction and having an outer rigid portion and an inner resilient portion.

6. The apparatus of claim 5 wherein said base has an opening extending vertically therethrough which permits the lower end of said cantilevered spring to pass through said base after passing through said receiving member.

7. The apparatus of claim 6 wherein said plurality of resilient members is comprised of a plurality of resilient cylinders, each of said resilient cylinders having its longitudinal axis extending in the vertical direction.

8. The apparatus of claim 7 wherein said plurality of resilient cylinders is comprised of six resilient cylinders and wherein each of said resilient cylinders and said receiving member have substantially the same outer diameter.

9. The apparatus of claim 1 and further comprising a plurality of studs attached to the bottom end of said receiving member and a plurality of clips attached to said base, each of said clips being positioned to align with one of said studs, and further comprising a plurality of resilient pads, each of said resilient pads being positioned between one of said clips and one of said studs, said clips, studs and resilient pads being adapted to secure said receiving members to said base in a manner which permits said receiving member to tilt in response to lateral forces applied to said receiving member above its bottom end but which does not permit said receiving member to tilt in response to lateral forces applied to said receiving member at its bottom end.

10. The apparatus of claim 1 and further comprising a rigid housing which surrounds said resilient member.

11. An apparatus for aligning an integrated deck with a jacket that is secured to the seafloor, said deck being carried by a floating vessel, said apparatus comprising:

(a) a plurality of cantilevered springs extending vertically downward from said deck, each of said cantilevered springs comprising a steel tubular;

(b) means for raising and lowering said cantilevered springs relative to said deck;

(c) a plurality of sockets secured to said jacket, each of said sockets being positioned to receive the lower end of one of said cantilevered springs, each of said sockets comprising:

(i) a cylindrical receiving member having its longitudinal axis extending in the vertical direction and having a wider internal diameter at its top end and a narrower internal diameter at its bottom end, said narrower internal diameter being slightly larger than the outer diameter of the lower end of said cantilevered spring, said receiving member being comprised of an outer rigid portion and an inner resilient portion;

(ii) a base having an opening extending vertically therethrough which permits the lower end of said cantilevered spring to pass through said base after passing through said receiving member;

(iii) a plurality of studs attached to the bottom end of said receiving member;

(iv) a plurality of clips attached to said base, each of said clips being positioned to align with one of said studs;

(v) a plurality of resilient pads, each of said resilient pads being positioned between one of said clips and one of said studs, said clips, studs and resilient pads being adapted to secure said receiving member to said base in a manner which permits said receiving member to tilt in response to lateral forces applied to said receiving member above its bottom end but which does not permit said receiving member to tilt in response to lateral forces applied to said receiving member at its bottom end;

(vi) a plurality of resilient cylinders positioned around said receiving member, each of said resilient cylinders having its longitudinal axis extending in the vertical direction, said resilient cylinders being adapted to apply a restoring force to said receiving member when said receiving member tilts; and (vii) a rigid housing which surrounds said resilient cylinders.

12. The apparatus of claim 11 wherein said plurality of resilient cylinders is comprised of six resilient cylinders and wherein each of said resilient cylinders and said receiving member have substantially the same outer diameter.

* * * * *